United States Patent [19]

Kulczycki et al.

[11] 3,965,939

[45] June 29, 1976

[54] HEDDLE WITH GUIDE MEANS THEREON FOR USE IN A WEAVING MACHINE FOR MAKING TRIAXIAL FABRICS

[76] Inventors: Karol Kulczycki, 36 Lawrence Road, Parsippany, N.J. 07054; Burns Darsie, 1603 Sexton Drive, Rockford, Ill. 61108; Norris F. Dow, 600 Allendale Road, King of Prussia, Pa. 19408

[22] Filed: July 18, 1975

[21] Appl. No.: 597,290

[52] U.S. Cl. ..... 139/48; 139/DIG. 1

[51] Int. Cl.[2] ..... D03C 13/00

[58] Field of Search ..... 139/46, 48, 1, DIG. 1, 139/54, 11, 419

[56] References Cited

UNITED STATES PATENTS

| | | | |
|---|---|---|---|
| 836,305 | 11/1906 | Craddock | 139/53 |
| 840,257 | 1/1907 | Sarafian | 139/53 |
| 1,368,215 | 2/1921 | Stewart | 139/419 |
| 3,042,081 | 7/1962 | MacIsaac | 139/46 |

*Primary Examiner*—Henry S. Jaudon

[57] ABSTRACT

An elongate heddle for a weaving machine for making triaxial fabrics is provided with a frontal portion having a warp strand guide opening extending therethrough, with means on the heddle adapted to be engaged for imparting longitudinal movement thereto during warp shed forming operations. The heddle also has means thereon adapted to be engaged for shifting the heddle weftwise of the weaving machine, and the frontal portion of the heddle has guide means thereon adapted to aid in guiding the heddle by cooperating with an adjacent heddle during movement thereof.

9 Claims, 5 Drawing Figures

TO FELL OF CLOTH
HEDDLE SHIFTING MEANS
SHED FORMING MEANS

HEDDLE WITH GUIDE MEANS THEREON FOR USE IN A WEAVING MACHINE FOR MAKING TRIAXIAL FABRICS

This invention relates to weaving machines, and more especially, to an improved heddle for a machine for weaving so-called triaxial fabrics. Triaxial fabrics are generally characterized by including at least two sets of warps interwoven with wefts and wherein one of the sets of warps crosses the other set and both sets of warps extend diagonally of the length of the fabric.

The art of weaving triaxial fabrics has been known for many years, as disclosed, for example, in Stewart's U.S. Pat. No. 1,368,215, and wherein heddles are arranged so as to be moved longitudinally for forming successive sheds of the warps extending through the heddles, and in which sheds the wefts are inserted, and the heddles also are arranged so as to be shifted weftwise following certain shed forming operations thereof so as to cause the respective warps to extend diagonally of the fabric being woven.

Experiments attendant to the recent development of more efficient machines for weaving triaxial fabrics have resulted in the use of weftwise rows of individual heddles, each of which is provided with means thereon adapted to be engaged for imparting longitudinal movements thereto for effecting warp shed forming operations, and which is also provided with means thereon adapted to be engaged for shifting the heddle weftwise of the weaving machine to obtain a desired diagonal disposition of the warps during the weaving of the triaxial fabrics.

It is an object of this invention to provide a heddle for weaving machines for making triaxial fabrics, which heddle, in addition to being adapted to be engaged for imparting longitudinal and weftwise movements thereto, is provided with guide means thereon adapted to aid in guiding the heddle by cooperating with an adjacent heddle during movements of the improved heddle.

It is another more specific object of this invention to provide a heddle of the type described which is an elongate strip material and includes a body portion of a predetermined width with an elongate reduced width frontal portion extending forwardly from the body portion and terminating in a nose portion having a warp strand guide opening extending therethrough. A rear portion of the heddle has a hook-shaped projection formed integral with the body portion and extending rearwardly thereof and adapted to be engaged for imparting longitudinal movement to the heddle. The body portion is provided with a shoulder portion extending along one edge thereof and adapted to be engaged for shifting the heddle weftwise of the weaving machine, and guide means is carried by the reduced width frontal portion and lies in a common plane therewith and also projects laterally from the reduced width frontal portion for guiding the frontal portion of the heddle during movement of the heddle by being adapted to cooperate with an adjacent heddle.

Some of the objects of the invention having been stated, other objects will appear as the description proceeds when taken in connection with the accompanying drawings, in which —

Figures 1, 2, 3, 4, 5:
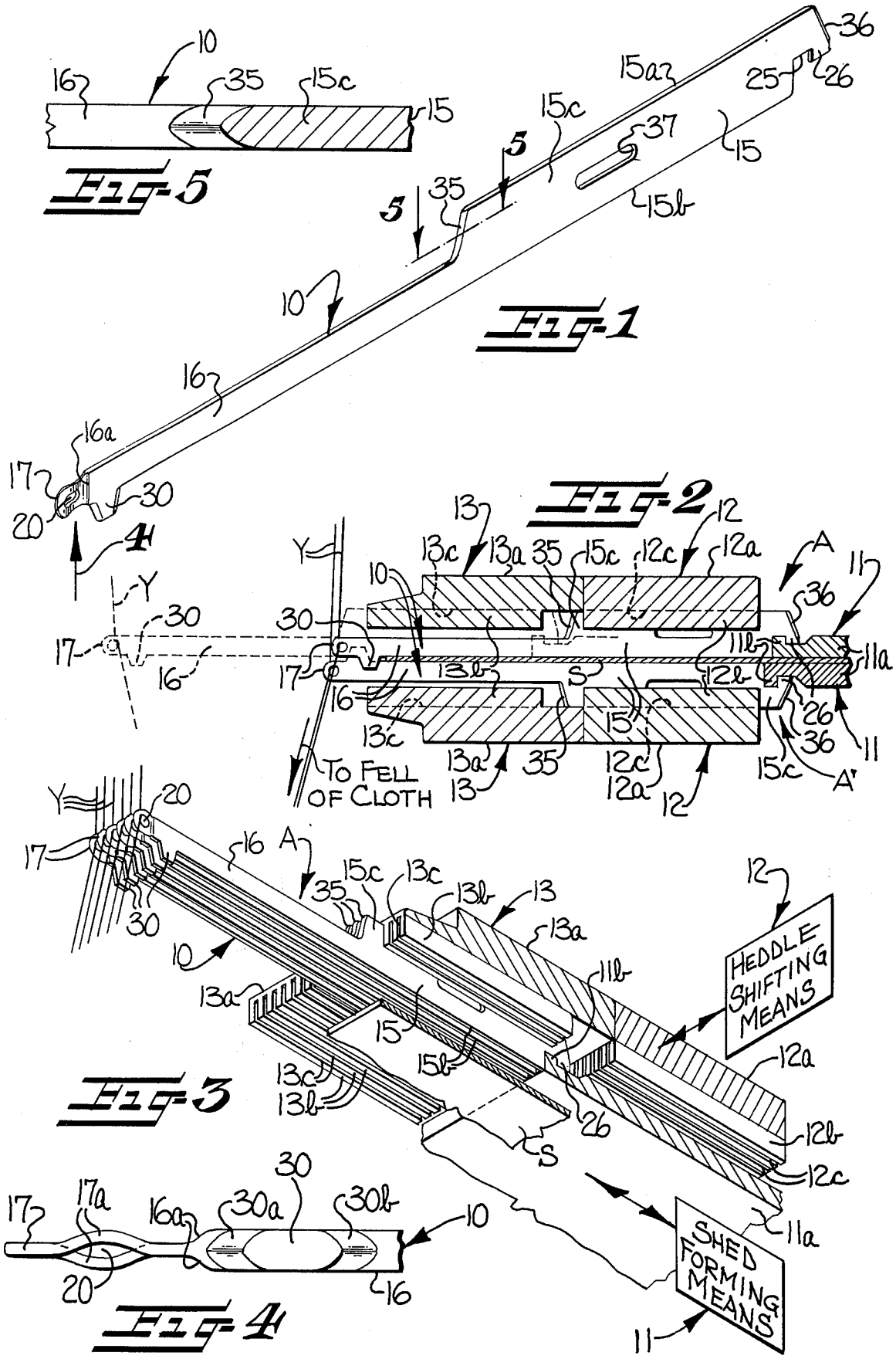
FIG. 1 is a perspective view of the preferred embodiment of the heddle of the present invention.
FIG. 2 is a fragmentary vertical sectional view looking crosswise of two superposed weftwise rows of the heddles of the present invention in association with a weaving machine having suitable warp shed forming means and heddle shifting means for moving the heddles longitudinally during warp shed forming operations and for shifting the heddles weftwise between certain shed forming operations.
FIG. 3 is a schematic perspective view looking upwardly at a few of the heddles in the upper row of FIG. 2 with blocks bearing legends representing suitable operating means for the shed forming means and the heddle shifting means.
FIG. 4 is an enlarged fragmentary view of the free front end portion and the guide means of the heddle looking substantially in the direction of the arrow indicated at 4 in FIG. 1.
FIG. 5 is an enlarged fragmentary sectional view taken substantially along line 5—5 in FIG. 1.

Referring more specifically to the drawings, the improved heddle, broadly designated at 10, is particularly devised for use with a machine for weaving fabric of a type having wefts extending transversely of the length of the fabric and including at least one set of warps extending diagonally of the fabric and crossing at least one other set of the warps which also extends diagonally of the fabric. Such fabrics are sometimes referred to as "triaxial" fabrics and, consequently, the machine with which the heddle 10 is adapted to be associated will be referred to herein as a "triaxial weaving machine". As shown schematically in FIGS. 2 and 3, the triaxial weaving machine may include two side-by-side or superposed weftwise rows A, A′ of the heddles 10 with a suitable plate or other dividing supporting surface means S positioned therebetween. The two rows of heddles are shown occupying substantially horizontal positions in FIG. 2 by way of illustration and for purposes of disclosure. It is to be understood, however, that the attitude or angular position of the rows of heddles may vary in different weaving machines without departing from the invention.

The operating mechanism for each row A, A′ of heddles 10 may include a warp shed forming means 11 for moving the respective weftwise row of the heddles longitudinally during warp shed forming operations, and heddle shifting means 12 for shifting the heddles weftwise of the weaving machine for shifting respective warps Y diagonally of the fabric being woven. For the purpose of this disclosure, only a few heddles 10 of the first or upper weftwise row A are shown in FIG. 3. However, each row of heddles is arranged to cooperate with a similar opposing row of heddles, not shown, for repeatedly forming warp sheds of the warps Y extending through the heddles to the fell of the fabric being woven.

The weaving machine is also provided with suitable heddle guide means 13 cooperating with the heddle shifting means 12 for guiding each respective row of heddles forwardly and rearwardly between a retracted position and an extended position as effected by the respective shed forming means 11. It should be noted that the warp shed may be open when the heddles occupy either the solid-line fully retracted or rearward position of FIG. 2 or the fully extended or forward position of FIG. 3, although the warps Y are positioned adjacent one side of the plane of the fell of the fabric when the heddles occupy one of the open-shed positions, and the warps Y are crossed and positioned adjacent the other side of the plane of the fell of the fabric when the heddles occupy the other open-shed position.

Each warp shed forming means 11 may include a weftwise extending heddle shedding bar 11*a* which is also shown occupying an extended open-shed position in FIG. 3. Bar 11*a* is movable forwardly and rearwardly and has an elongate weftwise extending projection or rib 11*b* thereon adapted to be engaged by each of the heddles 10 in the respective row in a manner to be later explained.

Heddle shedding bars 11*a* are movable in the spaces between plate S and the respective heddle shifting means 12, each of which is shown as comprising an elongate weftwise extending and weftwise movable heddle indexing or heddle shifting member or bar 12*a* provided with a weftwise row of closely spaced forwardly and rearwardly extending teeth or wall members 12*b* shown projecting from each bar 12*a* toward the shedding bar 11*a*. The teeth 12*b* are spaced apart from each other to define passageways or slots 12*c* therebetween adapted to slidably receive therein shoulder portions of respective heddles 10, as will be later described, preparatory to indexing or shifting the heddles weftwise of the weaving machine. Thus, the heddle shifting bars 12*a* also serve as movable heddle guiding members.

It should be noted that the heddles 10 in row A are staggered with respect to the heddles 10 in row A'. Thus, the distance between the centers of adjacent passageways 12*c* in heddle shifting bars 12*a* determines the distance between the centers of adjacent warps Y in the triaxial fabric to be woven. Therefore, in order to weave a dense triaxial fabric, it is apparent that it is preferred that the passageways 12*c* be quite close together and that the heddles be of relatively thin material so as to be properly guided in the passageways 12*c* during shed forming operations.

Each heddle guide means 13 may take the form of an elongate weftwise extending guide memeber or bar 13*a* which may be stationarily mounted. Each bar 13*a* is provided with a plurality of teeth or wall members 13*b* thereon shown projecting therefrom and spaced forwardly of the respective teeth 12*b* of the adjacent heddle shifting bar 12*a*. The teeth 13*b* of each heddle guide bar 13*a* define passageways or slots 13*c* therebetween which extend forwardly and rearwardly and are necessarily disposed in substantial alignment with the passageways 12*c* of the respective heddle shifting means 12 during any concurrent engagement of any of the heddles 10 with passageways 12*c*, 13*c* in both respective bars 12*a*, 13*a*.

Each heddle shifting means 12 may include suitable means, not shown, for imparting an active weftwise shifting movement or stroke to the respective heddle shifting bar 12*a* in one weftwise direction and relative to the respective guide bar 13*a* for a distance about equal to an integral multiple of the distance between the centers of adjacent passageways 12*c*, for example, following each of, or certain of, the rearward movements of each shedding bar 11*a* and heddles 10 in the respective row from the fully extended position shown in FIG. 3 to the fully retracted position, according to the desired pattern. Suitable heddle transfer means, not shown, may be provided for transferring each successive heddle from the leading end of each illustrated row of heddles to the trailing end of the aforementioned respective opposing row of heddles, not shown, following each active weftwise shifting stroke of each bar 12*a*. Similarly, since such opposing rows of heddles may be shifted in the opposite weftwise direction from the illustrated rows of FIG. 2, successive leading heddles may be transferred from the opposing rows of heddles to the trailing ends of the illustrated rows A, A'. Following each active shifting movement of heddle shifting bars 12*a* and upon subsequent forward movement of each shedding bar 11*a* and respective heddles 10 to the extended position shown in FIG. 2, an inactive stroke may be imparted to each heddle shifting bar 12*a*, in the opposite weftwise direction, to return the same to its original position.

It is apparent that the heddles 10 must be positioned out of engagement with the respective stationary guide bar 13*a* during any weftwise shifting movement of the heddles effected by engagement of the heddles 10 with the passageways 12*c* of the respective heddle shifting bar 12*a* during an active stroke thereof. Conversely, it is apparent that the heddles 10 in each row A, A' must occupy a fully extended position, or are in the course of a forward movement thereof approaching the fully extended position, whenever an inactive weftwise movement is being imparted to the respective heddle shifting bar 12*a* to return the same to its original position. In other words, the heddles 10 are in slidable engagement with a stationary guide bar 13*a* and must, therefore, be out of engagement with the respective shifting bar 12*a* during each inactive weftwise stroke of each bar 12*a*.

Since the means for moving the heddles 10 longitudinally, forwardly and rearward, the heddle shifting means 12, the heddle guide means 13 and the heddle transfer means, not shown, are mentioned herein as an illustrative environment for the improved heddle and do not constitute elements of the invention being claimed herein, a further more detailed description thereof is deemed unnecessary.

Each heddle 10 is of elongate form and may be formed of any suitable material which will not be adversely affected by changes in temperature and/or humidity of the ambient air in a weave room. For example, the heddle may be formed of plastic or any suitable metal, but it is preferred that the heddle be formed of stainless steel strip material.

As a non-limiting example, and depending upon how close together the warps must be positioned to obtain the desired density of the triaxial fabric to be woven, the heddle 10 may be in the range of about 0.015 to 0.032 inch thick (0.38 to 0.81 millimeters). It is apparent that the length and width of the heddle 10 should be suited to the environmental structure of the triaxial weaving machine. Thus, by way of illustration only, in heddles adapted for use in a particular weaving machine constructed to include shed forming means, heddle shifting means and heddle guide means of substantially the type heretofore described and shown in FIG. 2, it was determined that, desirably, the overall length of each heddle may be in the range of about 3.75 to 5 inches (95 to 127 millimeters) and at least the major portion of the heddle body portion, to be presently described, may be of a width in the range of about ⅜ to ½ inch (9.525 to 12.70 millimeters).

Each heddle 10 comprises an elongate body portion 15 of a predetermined width, and an elongate reduced width frontal portion 16 which extends forwardly from and is integral with body portion 15. The reduced width frontal portion 16 may be about one-half as wide as body portion 15 and terminates in a nose portion 17 having a rounded or substantially semicircularly-shaped free end which defines the front end of the heddle 10. The nose portion 17 has a strand guide opening or eye 20 extending therethrough for the respective warp Y and, since the respective warp Y may take the form of a textile yarn and passes alongside the nose portion 17 in its course through the strand guide opening 20 during weaving, it will be observed in FIG. 4 that the nose portion 17 is at least partially offset, as at 17*a*, in opposite directions on respective opposite sides of the guide opening 20 so as to avoid abrading the warp Y passing through the strand guide opening 20.

Since the nose portion 17 of each heddle 10 is at least partially offset on respective opposite sides thereof, it is preferred that the distance between the outer surfaces of such offset portions 17*a*, measured weftwise of nose portion 17, is no more than about the same as the thickness of the body portion 15 of heddle 10. Therefore, as best shown in FIG. 4, the elongate frontal portion 16 of the heddle 10 may be tapered or beveled, as at 16*a*, toward the free end of the nose portion 17 so that the portion of the length of strip material defining the nose portion 17 is of substantially less thickness than at least the major portion of the remainder of the length of the heddle 10.

It will be observed in FIG. 1 that the elongate body portion 15 of heddle 10 has opposing, substantially parallel, first and second longitudinal edges 15*a*, 15*b* thereon. The reduced width frontal portion 16 of heddle 10 is offset from the first longitudinal edge 15*a* toward the second longitudinal edge 15*b* of body portion 15 so that the first longitudinal edge 15*a* defines a projecting shoulder portion 15*c* on at least a medial portion of the heddle and extending along one edge thereof. It is preferred that the edge of the reduced width frontal portion 16 facing away from shoulder portion 15*c*; i.e., the bottom edge of frontal portion 16 in FIGS. 1 and 2, is substantially coextensive with the second longitudinal edge 15*b* of body portion 15. As will be later explained, shoulder portion 15*c* represents a preferred embodiment of means on the heddle adapted to be engaged for shifting the heddle weftwise of the weaving machine.

The heddle also is provided with means adapted to be engaged for imparting longitudinal movement thereto. To this end, the rear portion of each heddle 10 has a cutout 25 therein adapted to be engaged by the elongate rib 11*b* of the respective shed forming means 11, for example, for imparting longitudinal or shedding movements to heddle 10. A hook-shaped projection 26 is integral with and extends rearwardly of body portion 15 to define the tail of the heddle. As preferred, the hook-shaped projection 26 partially defines the cutout 25 and terminates short of the plane of the adjacent second longitudinal edge 15*b* of the body portion 15 of heddle 10 so that, when cutout 25 and projection 26 are properly engaged by shedding bar 11*a*, as shown in FIGS. 2 and 3, both the shedding bar 11*a* and the longitudinal edge 15*b* of each heddle body portion 15 may be positioned in sliding engagement with a suitable planar guide surface as represented by the stationary guide plate S shown in FIGS. 2 and 3. In this regard, it will be observed in the right-hand portion of FIG. 2 that the hook-shaped projection 26 is adapted to be engaged by rib 11*b* of the respective shed forming means 11 for imparting longitudinal shedding movements to heddle 10. Also, it is apparent that the cutout 25 and hook-shaped projection 26 of each heddle 10 may readily be moved weftwise along the rib 11*b* of each respective shedding bar 11*a* anytime the heddles are being shifted weftwise by a heddle shifting bar 12*a*. Although it is preferred that the cutout 25 and projection 26 are shaped and positioned as described above, it is to be understood that the shape and position of cutout 25 and projection 26 may be different from that described so as to accord with variations in the environmental shed forming means of the weaving machine.

As shown in FIG. 3, and as is preferred, the distance between the upper surface of stationary guide plate S and those surfaces of the bars 12*a*, 13*a* from which the respective teeth or wall members 12*b*, 13*b* project, and which define bridging end walls of the heddle guiding passageways 12*c*, 13*c*, may be only slightly greater than the width of the body portions 15 of the heddles 10. Thus, the first longitudinal edges, or the upper edges 15*a* of the body portions 15 of the heddles in upper row A as viewed in FIGS. 1, 2 and 3, may be moved in sliding engagement with the upper heddle guiding passageways 12*c*, 13*c* and the upper heddles 10 may be slidably supported for movement by their edges 15*b* resting upon the upper surface of stationary guide plate S, as viewed in FIGS. 2 and 3.

Since it is preferred that the longitudinal edges 15*a*, 15*b* of each heddle 10 are substantially parallel, the heddles 10 may be properly guidingly engaged while occupying any desired inclined, horizontal or vertical position. For example, the structure shown in association with lower row A′ of heddles 10 in FIG. 2 is arranged so that the heddle shedding bar 11*a*, the heddle shifting bar 12*a*, the heddle guide bar 13*a* and heddles 10 are inverted with respect to the positions of the similar elements 11*a*, 12*a*, 13*a* and 10 of the upper row A of heddles 10. With such an inverted arrangement, it is apparent that the teeth 12*b*, 13*b* extend upwardly toward guide plate S from the heddle shifting bar 12*a* and heddle guide bar 13*a*, respectively, and that the heddles 10 in the lower row A′ are slidably supported for movement by the first longitudinal edges 15*a* thereof resting upon the aforementioned bridging wall portions of the lower passageways 12*c*, 13*c*. It is thus seen that, as preferred, the edges 15*a*, 15*b* of body portion 15 of each heddle 10 serve as opposing, spaced apart, substantially parallel longitudinal edges for the heddle 10 so that the heddle may be selectively positioned to be slidably supported for movement by either of the longitudinal edges resting upon a supporting surface.

As indicated above, the shoulder portions 15*c* of the heddles engage the passageways 12*c*, 13*c* in both respective bars 12*a*, 13*a*. It is to be noted, however, that the length of the shoulder portion 15*c* of each heddle 10 is such with respect to the length of the teeth 12*b*, 13*b* of each respective pair of bars 12*a*, 13*a*, with respect to the distance from teeth 12*b* to teeth 13*b*, that the shoulder portions 15*c* are adapted to be moved out of engagement with the teeth 13*b* of each stationary heddle guide bar 13*a* and into engagement with the teeth 12*b* of the respective heddle shifting bar 12*a* during each rearward movement of heddles 10 in a respective row by a shedding bar 11*a* from the extended position to the fully retracted position. Thus, the heddle shoulder portions 15*c* are then positioned so as to permit each respective heddle shifting bar 12*a* to shift the heddles 10 weftwise of the weaving machine relative to the respective stationary heddle guide bar 13*a*.

It is also to be noted that, because the elongate frontal portions 16 of the heddles 10 are of reduced width relative to the body portions 15 and also are offset from the first longitudinal edges 15*a* of the heddles and toward the second longitudinal edges 15*b*, the elongate frontal portions 16 are spaced from the respective teeth 13*b* as the shoulder portions 15*c* of the heddle body portions 15 are withdrawing from passageways 13*c* and entering passageways 12*c*. In other words, the reduced width frontal portions 16 of the heddles 10 in each row A, A′ are positioned between stationary plate S and the respective stationary heddle guide bar 13*a* and the heddles are out of engagement with teeth 13*b* whenever they occupy the fully retracted position.

Of course, even though the heddles occupy the fully retracted position upon alternate shed forming strokes thereof, the nose portions 17 thereof are then located forwardly, to the left of stationary guide bar 13*a* and guide plate S in FIG. 2, so as to avoid rupturing the warps Y by engagement thereof with stationary guide bars 13*a* and/or plate S. Even though the heddles 10 occupy the latter position during each weftwise shifting movement thereof, it can be appreciated that the reduced width frontal portions 16 of the heddles 10 then are clear of bars 13*a* so as to provide clearance for the heddles and to permit weftwise shifting of the heddles 10 past the respective guiding passageways 13*c* by heddle shifting bars 12*a*.

However, before the heddle shifting bars 12*a* subsequently reverse their direction of movement and return to their original positions as is desirable, the heddles 10 in FIGS. 2 and 3 may be moved forwardly to move the shoulder portions 15*c* thereof out of engagement with heddle shifting bars 12*a* as the ribs 11*b* on shedding bars 11*a* engage and push forwardly against the rear surfaces of the bodies 15 of the respective heddles, which rear surfaces may be defined by the cutouts 25. Thus, each bar 11*a* moves the respective heddles 10 to the fully extended position shown in dotted lines in FIG. 2 and in solid lines in FIG. 3. It is apparent that the shoulder portions 15*c* of the heddles 10 are moved into sliding engagement with and along the passageways 13*c* in heddle guide bars 13*a* as the rear ends of the heddles 10 are moved entirely out of engagement with heddle shifting bars 12*a*. Thereupon, each respective heddle shifting bar 12*a* may return to its original position, as heretofore indicated, and during which the heddles 10 are being maintained in the desired spaced relationship by heddle guide bars 13*a*. The operation is effected repeatedly so that the heddles may be progressively shifted weftwise of the weaving machine to cause the warps Y to extend diagonally of the fabric being woven.

As heretofore indicated, in order to weave a dense triaxial fabric, it is preferred that the passageways 12*c* in each heddle shifting bar 12*a* and the passageways 13*c* in each heddle guide bar 13*a* are positioned quite close together and that the heddles are of relatively thin material so as to be properly guided in the passageways 12*c*, 13*c* of the respective pair of bars 12*a*, 13*a* during shed forming operations. It has also been indicated that the heddles 10 in row A are staggared with respect to the heddles 10 in row A′. Thus, it is desirable, in many instances, that the distance between adjacent heddles 10 in upper row A is only slightly greater than the thickness of at least the major portions of the lengths of the heddles 10 in the bottom row A′, and vice versa, such as to provide a "running" clearance, e.g., about 0.001 to 0.002 inch (0.025 to 0.050 millimeters) between the adjacent heddles in the upper and lower rows A, A′. Accordingly, it is also preferred that the thickness of the walls 12*b*, 13*b* defining the guiding passageways 12*c*, 13*c* in the respective bars 12, 13*a* is substantially the same as that of at least the major portions of the lengths of the heddles 10 so as to provide a similar "running" clearance between the shoulder portions 15*c* of the heddles 10 and the walls of the respective passageways 12*c*, 13*c*.

It is apparent by referring to FIG. 2 that a substantial length of each heddle 10, which length is represented by the elongate reduced width frontal portion 16 of each respective heddle 10, extends beyond the body portion 15 and the respective shoulder portion 15*c* of the respective heddle 10 and that only the shoulder portions 15*c* of heddles 10 in each row A, A′ are slidably and guidingly engaged in the respective pairs of weftwise rows of passageways 12*c*, 13*c* at any time during the operation of the respective shed forming means 11 and/or the respective heddle shifting means 12. Also, whenever any of the heddles 10 in the upper row A occupies the extended position indicated in broken lines in FIG. 2 and in solid lines in FIG. 3, it is apparent that the reduced width frontal portions 16 of the heddles 10 in upper row A extend beyond the supporting surface of plate S in a cantilever manner. Similarly, the entire length of the reduced width frontal portion 16 of each heddle 10 in the lower row A′ of FIG. 2 extends from the body portion 15 and the shoulder portion 15*c* of the respective heddle in a cantilever manner.

Since it is preferred that each heddle 10 is formed of a length of elongate, thin material, it can be appreciated that the reduced width frontal portions 16 thereof might be readily, but undesirably, flexed or bent transversely or weftwise relative to the body portions 15 during operation of the weaving machine and/or in the process of manufacture of the individual heddles 10. Also, since the warps Y may frictionally engage the nose portions 17 of the respective heddles 10 as the warps Y pass through the respective warp strand guide openings 20, it can be appreciated that the warps Y might apply force to the extended reduced width frontal portions of heddles 10 toward the fell of the fabric being woven, and because of the heddles being of greater width in the warpwise direction than the thickness thereof, such force may tend to bow the forwardly extended reduced width frontal portions 16 of the heddles 10 sideways relative to the body portions 15 and shoulder portions 15*c* thereof. Such problem can be further aggravated by the weftwise shifting movements which are necessarily imparted to the heddles 10 in each row A during at least certain periods in which the heddles 10 occupy the retracted positions shown in solid lines in FIG. 2 with their edges slidably engaging guide plate S.

Therefore, according to the invention, the individual heddles 10 are provided with means for guiding the frontal portions 16 thereof during movement of the heddles irrespective of whether one or more of the heddles may be in a bent condition. More specifically, each heddle 10 includes a guide means or guide portion 30 for guiding the frontal portion 16 during movement of the heddle by being adapted to cooperate with an adjacent heddle, as by being positioned alongside an adjacent heddle or between adjacent heddles in the row of heddles warpwise thereof. In other words, it will be observed in FIG. 2 that each guide portion 30 is carried by the reduced width frontal portion 16 of the respective heddle 10 and lies in a common plane with the respective frontal portion and projects laterally therefrom outwardly beyond the second longitudinal edge 15*b* of the respective body portion 15 so that the guide portions 30 of the heddles in row A extend between the frontal portions 16 of adjacent heddles in the row A′, and vice versa.

As described heretofore herein, the strip material of which the heddle preferably is formed is of lesser thickness in the nose portion 17 thereof than at least the major portion of the remainder of the respective heddle 10. However, it is preferred that the front edge of each guide portion 30 terminates closely adjacent and rearwardly of nose portion 17, with each guide portion 30 being in the form of a relatively small tab of about the same thickness as at least the major portion of the length of the respective heddle 10.

Since the opposing longitudinally extending edges of an elongated strip material define the body portion 15 therebetween, it can be seen that one of the longitudinally extending edges of the strip material extends forwardly beyond body portion 15 and defines an edge of frontal portion 16 which is substantially aligned with and is coextensive with the second longitudinal edge 15*b* of body portion 15 of the respective heddle 10. Thus, in its preferred embodiment, each guide portion 30 projects laterally from and is integral with the latter edge of the reduced width frontal portion 16 and is positioned closedly adjacent to and rearwardly of the free front end portion or nose portion 17 of the frontal portion 16 of the respective heddle 10.

As indicated in broken lines in FIG. 2, the heddles 10 in either row A, A′ may be extended relative to the heddles in the other row at certain times during the operation of the triaxial weaving machine. It follows, therefore, that the free ends of the frontal portions 16, including the nose portions 17 and the guide portions 30 of the heddles 10, may be extended in a cantilever manner with respect to the heddles in the adjacent row. Accordingly, it is preferred that the front and rear edges 30*a*, 30*b* of each guide portion 30 are of reduced thickness, as by being rounded or beveled as shown in FIGS. 1 and 4, so as to aid in guiding the guide portions 30 of the heddles into and out of cooperating side-by-side relationship with respect to each other.

It should be noted that each guide portion 30 may be of substantially greater length than that indicated in the drawings with respect to the length of each respective heddle 10, and the specific location of each guide portion 30 may differ from that described in accordance with variations in the environmental construction of the weaving machine, without departing from the invention. In the preferred embodiment, however, the heddle guide portions 30 are shown positioned closely adjacent the nose portions 17 of the heddles 10 and are relatively short so that, when the heddles occupy the retracted portions shown in solid lines in FIG. 2, the guide portions 30 are positioned forwardly of and extend past the forward edge of guide plate S so that the guide portions 30 of the heddles in row A extend beside the guide portions 30 and the reduced width frontal portions 16 of the heddles in row A′, and vice versa. Also, this permits the proximal edges 15*b* of the heddles in rows A, A′ to slide against the distal surfaces of guide plate S during any longitudinal or weftwise movement imparted to the heddles 10 by the corresponding heddle shedding bars 11*a* and heddle shifting bars 12*a* in the manner theretofore described.

Referring now to the shoulder portion 15*c* of each heddle 10, to aid in guiding such shoulder portion into the respective guiding passageway 13*c* of the respective guide bar 13*a* during the forward movement of each respective heddle from the retracted position to the extended position, it is preferred that each projecting shoulder portion 15*c* is provided with a reduced thickness front edge 35, as by being beveled or rounded at its juncture with the reduced width frontal portion 16 of each heddle 10. Additionally, it is preferred that each body portion 15 is porvided with a reduced thickness rear end edge 36 thereon, as by being beveled or rounded, to aid in guiding each heddle shoulder portion 15*c* into a respective one of the guiding passageways 12*c* of each heddle shifting bar 12*a* during longitudinal movement of the respective heddle 10 in the rearward direction; i.e., toward the retracted position. To aid further in guiding the shoulder portion 15*c* of each heddle 10 into the guiding passageways 12*c*, 13*c* of the respective bars 12*a*, 13*a*, it is preferred that the reduced thickness edges 35, 36 also are convergently inclined with respect to the first longitudinal edge 15*a* of the heddle, with the front edge 35 of each shoulder portion 15*c* being generally inclined rearwardly from the adjacent longitudinal edge of frontal portion 16, and with the rear edge 36 of each body portion 15 being generally inclined forwardly from the outer surface of the hook-shaped projection 26.

There are various ways in which an installer may position the heddles 10 in the desired operative relation to the bars 11*a*, 12*a*, 13*a* substantially as shown in FIG. 2. For example, the installer may insert the heddles, one at a time, rearwardly into the respective passageways 13*c* of the corresponding heddle guide bars 13*a*. During such rearward insertion of the heddles, the heddle shifting bars 12*a* may be positioned sufficient distances away from plate S so as to permit the installer to readily position the cutouts 25 and hook-shaped projections 26 of the heddles 10 in proper engagement with the corresponding heddle shedding bars 11*a* with the heddles in registration with the respective passageways 12*c* of the corresponding heddle shifting bars 12*a*. Thereafter, the heddle shifting bars 12*a* may be positioned as shown in FIG. 2, where they are suitably guided during the weftwise movements thereof. The installation of the heddles is then completed for the threading of the warps Y therethrough in setting up the machine for weaving triaxial fabrics. If desired, each heddle 10 may be provided with a suitable opening therethrough, such as an elongate slot 37 extending transversely through body portion 15, for aiding in properly locating and/or anchoring the heddles 10 in the course of manufacture of the heddles.

It is thus seen that there is provided an improved elongate heddle for a weaving machine for making triaxial fabrics, which heddle is adapted to be moved longitudinally during warp shed forming operations and is also adapted to be shifted weftwise, and wherein the heddle has a frontal or nose portion with a warp strand guide opening extending therethrough and also has means thereon adapted to be engaged for imparting longitudinal movement thereto. Also, it can be seen that the heddle has means thereon adapted to be engaged for shifting the heddle weftwise of the weaving machine, and that guide means is carried by each heddle and is adapted to aid in guiding the heddle by cooperating with an adjacent heddle during movement thereof.

In the drawings and specification there has been set forth a preferred embodiment of the invention, and although specific terms are employed, they are used in a generic and descriptive sense only, and not for purposes of limitation.

That which is claimed is:

1. An elongate heddle for a weaving machine for making triaxial fabrics wherein the heddle is adapted to be moved longitudinally during warp shed forming operations and also is adapted to be shifted weftwise of the weaving machine, said heddle having a frontal portion with a warp strand guide opening extending therethrough, said heddle having means thereon adapted to be engaged for imparting longitudinal movement thereto, said heddle also having other means thereon adapted to be engaged for shifting the heddle weftwise of the weaving machine, and guide means carried by said frontal portion of the heddle and lying in a common plane with said frontal portion and projecting laterally therefrom for guiding said frontal portion of the heddle during movement of the heddle by being adapted to cooperate with an adjacent heddle.

2. A heddle according to claim 1 wherein said frontal portion includes a nose portion defining the front end of the heddle and through which said guide opening extends, and wherein the forwardmost extent of said guide means is adjacent to and rearwardly of said nose portion.

3. A heddle according to claim 1 wherein said guide means is in the form of a relatively small tab.

4. A heddle according to claim 1 wherein said guide means is of about the same thickness as the frontal portion from which it projects.

5. A heddle according to claim 1 wherein said guide means is provided with front and rear edges of reduced thickness for facilitating movement of the guide means into cooperating relation with an adjacent heddle.

6. An elongate heddle for a weaving machine for making triaxial fabrics, wherein the heddle is adapted to be moved longitudinally during warp shed forming operations and is also adapted to be shifted weftwise of the weaving machine, said heddle being an elongate strip material having a rear portion with means thereon adapted to be engaged for imparting longitudinal movement to the heddle, said heddle also having a body portion adapted to be engaged for shifting the heddle weftwise of the weaving machine and a frontal portion extending forwardly from said body portion and terminating in a free front end portion, said free front end portion having a warp strand guide opening extending therethrough, and guide means in the form of a tab carried by said frontal portion of the heddle and positioned adjacent to and rearwardly of said free front end portion, said tab lying in a common plane with said frontal portion and projecting laterally therefrom and being adapted to cooperate with an adjacent heddle for guiding said frontal portion during movement of the heddle.

7. A heddle according to claim 6 wherein said elongate strip material has opposing longitudinally extending and substantially parallel edges thereon defining said body portion therebetween and wherein one of said edges of said strip material extends forwardly beyond said body portion and defines one edge of said frontal portion, said frontal portion being of reduced width relative to said body portion, and said tab being positioned to project laterally from said frontal portion along said one edge of said frontal portion.

8. An elongate heddle for a weaving machine for making triaxial fabrics wherein the heddle is adapted to be moved longitudinally during a warp shed forming operation and also is adapted to be shifted weftwise of the weaving machine, said heddle being an elongate strip material and comprising a body portion of a predetermined width having means thereon adapted to be engaged for shifting the heddle weftwise of the weaving machine, an elongate reduced width frontal portion extending forwardly from said body portion and terminating in a nose portion having a warp strand guide opening extending therethrough, said reduced width frontal portion being adapted to provide clearance for the heddle so as to permit the weftwise shifting of the heddle past a heddle guiding passageway, said heddle also having means thereon adapted to be engaged for imparting longitudinal movement thereto, and guide means carried by said reduced width frontal portion and lying in a common plane with said frontal portion and projecting laterally therefrom outwardly beyond the width of the body portion and being positioned closely adjacent and rearwardly of the nose portion of said frontal portion of the heddle for guiding said reduced width frontal portion of the heddle during movement of the heddle by being adapted to cooperate with an adjacent heddle.

9. An elongate heddle for a weaving machine for making triaxial fabrics wherein the heddle is adapted to be moved longitudinally during a warp shed forming operation and is also adapted to be shifted weftwise of the weaving machine, said heddle being an elongate strip material and comprising an elongate body portion of a predetermined width having opposing first and second longitudinal edges thereon, an elongate reduced width frontal portion projecting from a front end of said body portion and terminating in a free front end portion having a warp strand guide opening extending therethrough, said reduced width frontal portion being offset from said first longitudinal edge of said body portion and toward said second longitudinal edge so as to define a shoulder portion extending along said first longitudinal edge and adapted to be engaged for shifting the heddle weftwise of the weaving machine, said heddle having a rear portion with means thereon adapted to be engaged for imparting longitudinal movement to the heddle, and guide means carried by said reduced width frontal portion of the heddle and lying in a common plane with said frontal portion and projecting laterally therefrom and outwardly beyond said second longitudinal edge for guiding said reduced width frontal portion of the heddle during movement of the heddle by being adapted to cooperate with an adjacent heddle.

* * * * *

UNITED STATES PATENT AND TRADEMARK OFFICE

CERTIFICATE OF CORRECTION

PATENT NO. : 3,965,939

DATED : June 29, 1976

INVENTOR(S) : Karol Kulczycki et al.

It is certified that error appears in the above-identified patent and that said Letters Patent are hereby corrected as shown below:

Page 1, following item [76] insert - [73] Assignee: Barber-Colman Company, Rockford, Illinois;

Column 9, Line 59, "portions" should be --positions--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*